US008127452B2

(12) United States Patent
Garavaglia et al.

(10) Patent No.: US 8,127,452 B2
(45) Date of Patent: Mar. 6, 2012

(54) UTILITY KNIFE

(75) Inventors: Joe Garavaglia, Newport Beach, CA (US); Markus Gropl, Huntington Beach, CA (US); Mark Marinovich, Rancho Santa Fe, CA (US)

(73) Assignee: Pacific Handy Cutter, Inc., Irvine, CA (US)

( * ) Notice: Subject to any disclaimer, the term of this patent is extended or adjusted under 35 U.S.C. 154(b) by 404 days.

(21) Appl. No.: 12/393,719

(22) Filed: Feb. 26, 2009

(65) Prior Publication Data

US 2010/0212164 A1 Aug. 26, 2010

(51) Int. Cl.
*B26B 1/00* (2006.01)
*B26B 29/00* (2006.01)

(52) U.S. Cl. ..... 30/2; 30/151; 30/286; 30/294

(58) Field of Classification Search ..... 30/2, 162, 30/286, 335, 294
See application file for complete search history.

(56) References Cited

U.S. PATENT DOCUMENTS

| | | | | |
|---|---|---|---|---|
| 3,781,988 | A * | 1/1974 | Jones | 30/2 |
| 3,943,627 | A * | 3/1976 | Stanley, Jr. | 30/151 |
| 5,241,750 | A * | 9/1993 | Chomiak | 30/2 |
| 5,878,501 | A * | 3/1999 | Owens et al. | 30/286 |
| 5,890,290 | A * | 4/1999 | Davis | 30/2 |
| 6,178,640 | B1 * | 1/2001 | Votolato | 30/2 |
| 6,560,873 | B1 * | 5/2003 | Ortner et al. | 30/2 |
| 6,578,266 | B2 * | 6/2003 | Chomiak | 30/2 |
| 6,718,637 | B1 * | 4/2004 | Ortner et al. | 30/2 |
| 7,356,928 | B2 * | 4/2008 | Votolato | 30/2 |
| 7,774,942 | B2 * | 8/2010 | Schmidt | 30/162 |

* cited by examiner

*Primary Examiner* — Hwei C Payer
(74) *Attorney, Agent, or Firm* — Henricks, Slavin & Holmes LLP

(57) ABSTRACT

A utility knife includes a handle, a blade carrier, and a blade depth adjustment assembly. The blade carrier is mechanically coupled to the handle and configured to support a blade. The blade depth adjustment assembly is mechanically coupled to the handle and configured to permit a user of the utility knife to reposition components of the blade depth adjustment assembly to select one of a plurality of blade depth positions which causes the blade carrier to be repositioned along the handle depending upon which of the blade depth positions is selected.

10 Claims, 18 Drawing Sheets

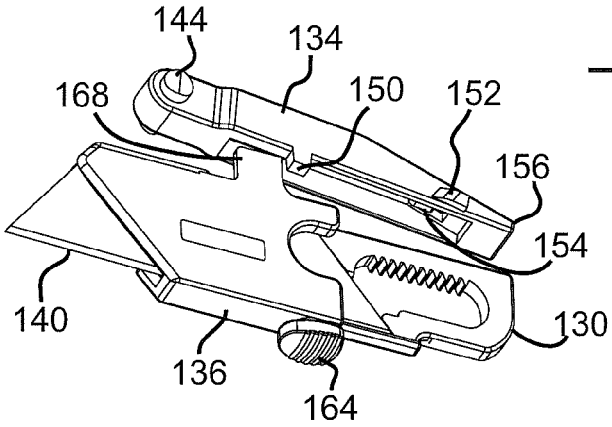
FIG. 15c
FIG. 15d
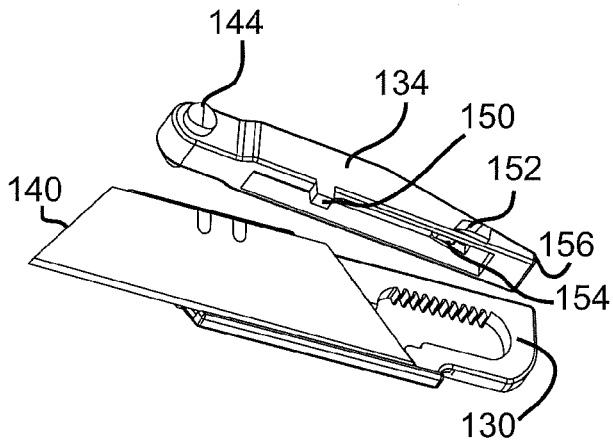
FIG. 15e
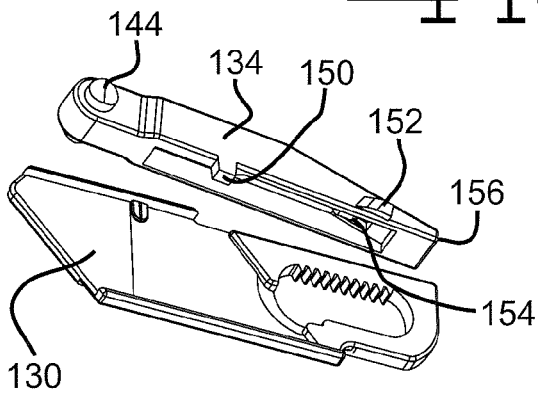

UTILITY KNIFE

CROSS-REFERENCE TO RELATED APPLICATIONS

This application is related to co-owned U.S. patent application Ser. No. 11/539,839 entitled "Utility Knife" filed on Oct. 9, 2006, now U.S. Pat. No. 7,774,942.

TECHNICAL FIELD

The present invention relates generally to knives and, in particular, a utility knife with blade depth adjustment, front blade change, and/or spare blade storage and shuttle features.

BACKGROUND ART

Various blades, knives, box cutters and the like (collectively, "tools") are known, some of which are provided with one or more of: an actuator mechanism for extending a blade from the tool, a blade release mechanism, and a receptacle for storing a spare blade or blades.

For a tool user, depending upon the task at hand, it may be desirable to adjust how far the blade is extended from the tool, i.e., the blade depth. Unfortunately, known actuator mechanisms for extending a blade from the tool tend to be of limited utility beyond performing the basic functions of extending and, in some instances, retracting the blade. It would be useful to be able to provide a blade depth adjustment feature for a utility knife which allows the user of the knife to safely select one of multiple blade depth positions and secure the blade in the selected position, maintaining the selected position even when significant force is brought to bear against the blade while cutting.

Many blade release mechanisms are known. However, for tools that include a blade cover (or blade hood), the manual manipulation of blade carrier release latches and other such devices that facilitate a front end blade change potentially interferes with the additional required task of repositioning the blade cover or hood to provide sufficient clearance to perform the front end blade change operation. It would be useful to be able to provide a blade release feature for a utility knife which allows the user of the knife to safely release the blade (so that it may be replaced) while simultaneously repositioning the blade cover or hood out of the way of the front end blade change operation.

While some tools include a receptacle for storing a spare blade or blades, known utility knifes are not optimally configured for storing as well as conveniently and safely dispensing spare blades. It would be useful to be able to provide spare blade storage and dispensing features for a utility knife which address one or more of the deficiencies of prior devices.

SUMMARY OF THE INVENTION

In an example embodiment, a utility knife includes a handle, a blade carrier, and a blade depth adjustment assembly. The blade carrier is mechanically coupled to the handle and configured to support a blade. The blade depth adjustment assembly is mechanically coupled to the handle and configured to permit a user of the utility knife to reposition components of the blade depth adjustment assembly to select one of a plurality of blade depth positions which causes the blade carrier to be repositioned along the handle depending upon which of the blade depth positions is selected.

In an example embodiment, a utility knife includes a handle, a blade carrier, a blade hood, a pushrod, and a blade release member. The blade carrier is mechanically coupled to the handle and configured to support a blade. The blade hood is mechanically coupled to the handle facilitating manipulability of the blade hood to an extended position over the blade. The pushrod is mechanically coupled to the blade hood and includes a protrusion that extends toward the blade carrier. The blade release member includes a button that extends through a slot in the housing and is mechanically engaged with the blade carrier to slide there along when the button is moved along the slot. The blade release member includes an upper portion that makes contact with the protrusion when the blade release member is moved along the slot such that the pushrod is repositioned within the handle and the blade hood is retracted from the extended position to allow the blade to be removed from the blade carrier.

In an example embodiment, a utility knife includes a handle and a spare blade dispenser. The handle includes a main portion and a back portion configured to be pivotally repositioned to an opened position. The spare blade dispenser is secured to the back portion to be accessible by a user of the utility knife when the back portion is in the opened position. The spare blade dispenser includes a blade receptacle sized to hold spare blades and a shuttle mechanically coupled to the blade receptacle such that the shuttle, when repositioned laterally with respect to the blade receptacle, engages and extends a topmost spare blade from the blade receptacle.

BRIEF DESCRIPTION OF THE DRAWINGS

FIG. 11*b* is a perspective view of the right back body portion of FIG. 11*a* shown with the spare blade dispenser separated there from;

FIG. 15*c* is a left perspective view of the blade carrier, blade, pushrod, and blade release member;

FIG. 15*d* is a left perspective view of the blade carrier, blade, and pushrod;

FIG. 15*e* is a left perspective view of the blade carrier and pushrod;

DISCLOSURE OF INVENTION

Referring to FIGS. 1*a*-4*c*, 7*a* and 7*b*, in an example embodiment, a utility knife 100 includes a left (or main) body portion 102, a right front body portion 104, and a right back body portion 106, formed as shown. Assembled, the left body portion 102, the right front body portion 104, and the right back body portion 106 provide a handle for the utility knife 100. In an example embodiment, the left body portion 102, the right front body portion 104, and the right back body portion 106 are made of a rigid, durable material such as zinc. It should be appreciated, however, that other materials can also be used.

Figure 1A:
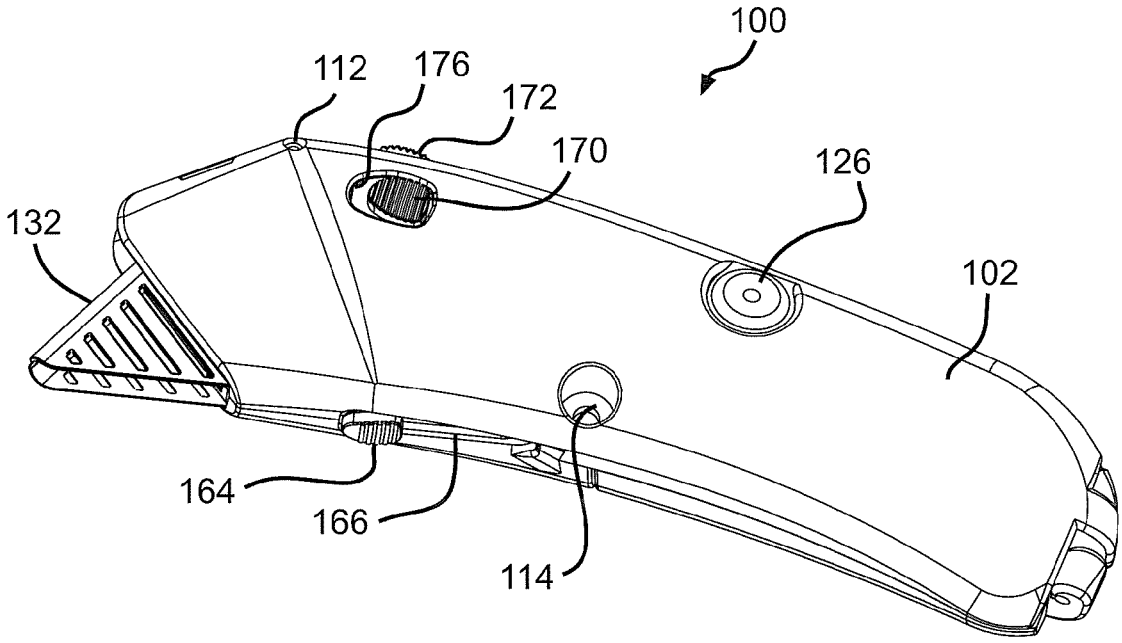
FIGS. 1*a* and 1*b* are perspective views of an example embodiment of a utility knife.
Figure 1B:
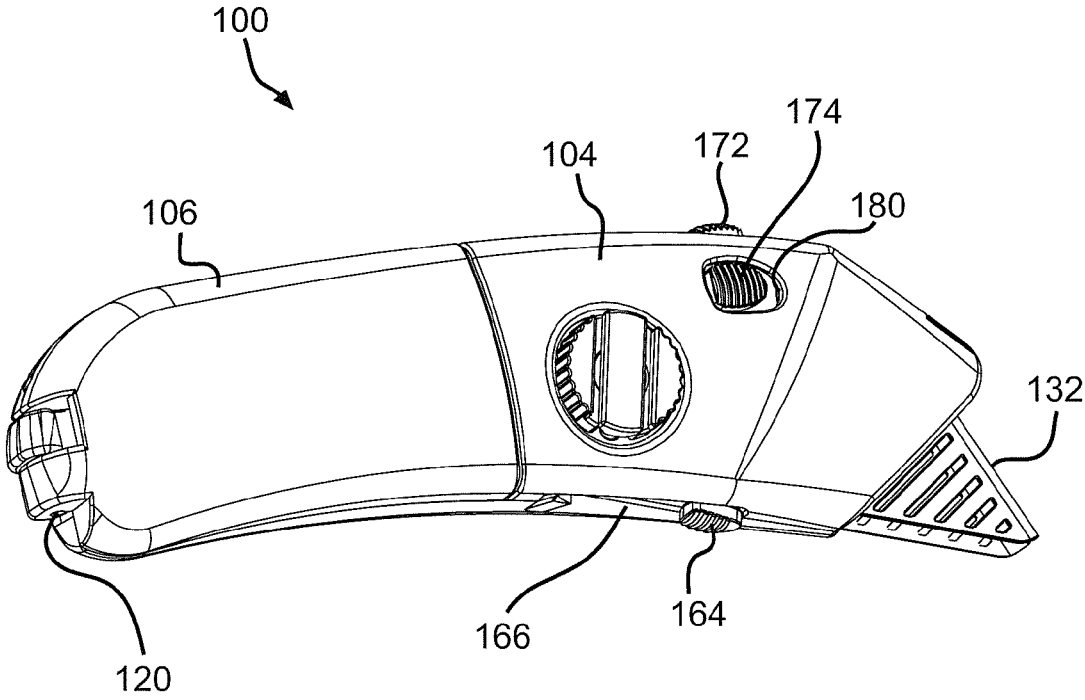
Figure 2A:
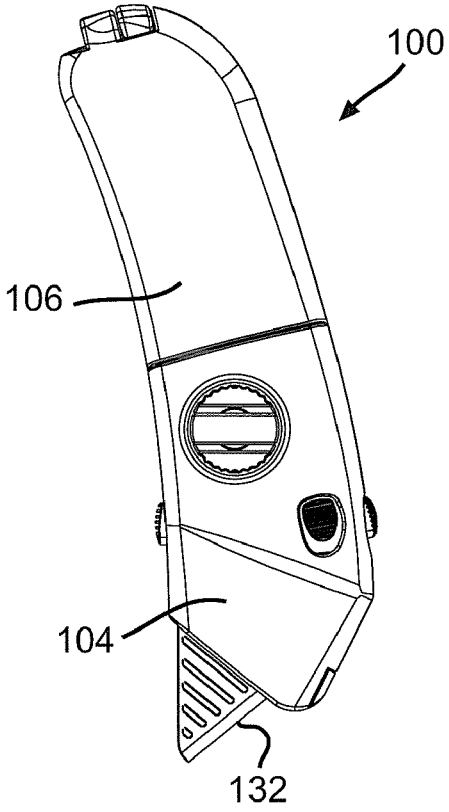
FIGS. 2*a*-2*f* are right side, top, back, front, left side, and bottom views, respectively, of the utility knife.
Figure 2B:
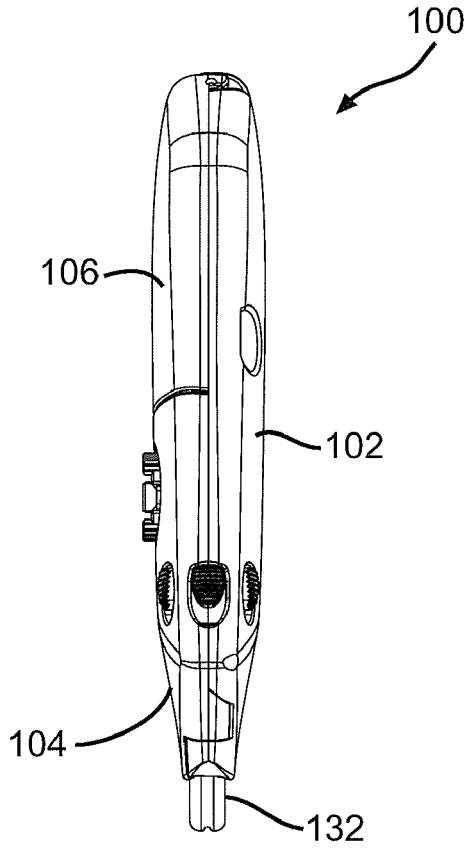
Figure 2C:
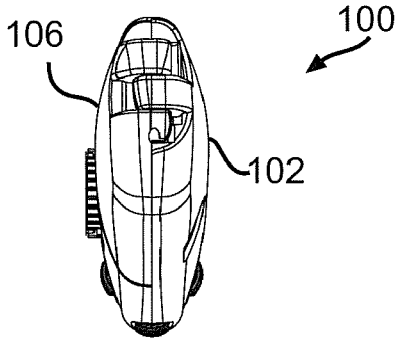
Figure 2E:
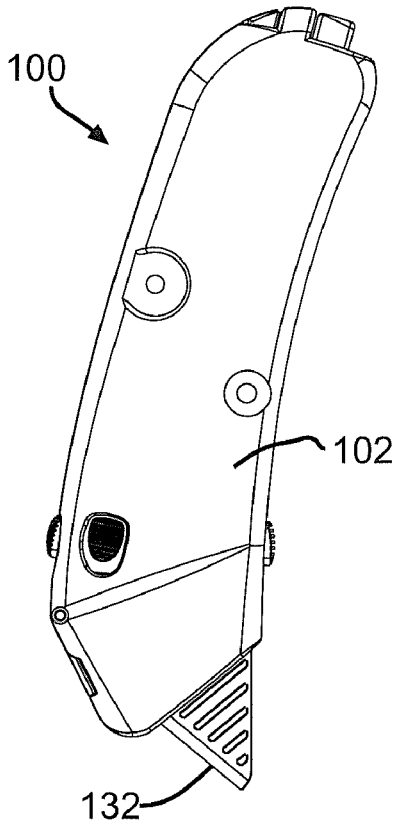
Figure 2F:
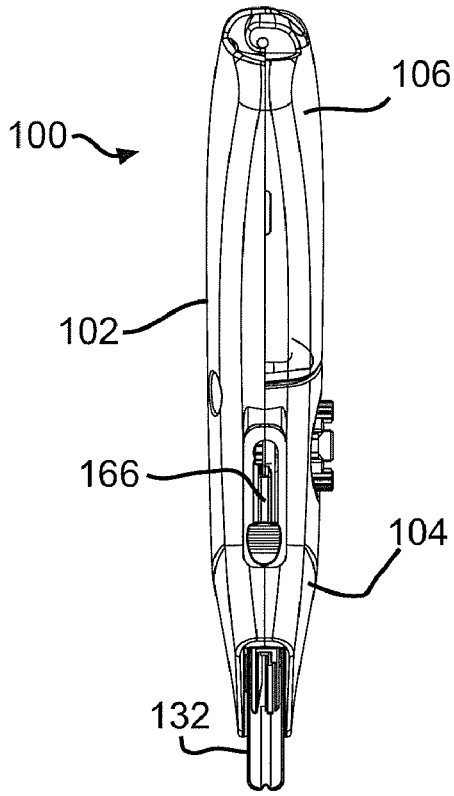
Figure 2D:
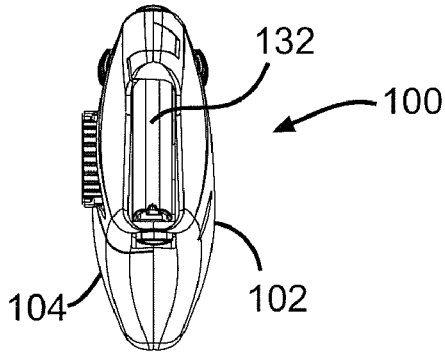

In this example embodiment, the left body portion 102 includes openings 108 and 110 (FIG. 7*a*) through which screws 112 and 114 (FIG. 1*a*) are inserted and secured within threaded openings 116 and 118 (FIG. 7*b*), respectively. The right back body portion 106 and the left body portion 102 are pivotally secured together as shown with a pin 120 (FIG. 1*b*). In this example embodiment, the left body portion 102 includes an opening 122 (FIG. 7*a*) and the right back body portion 106 includes a threaded opening 124 (FIG. 7*b*) into which a lock device 126 (FIG. 1*a*), such as a lock wheel, is threaded to secure the right back body portion 106 and the left body portion 102 together. Thus, the lock device 126 is configured to selectively secure the right back body portion 106 in a closed position or release the right back body portion 106 such that it can be repositioned to an opened position. In an example embodiment, the lock wheel is accessible external to the main portion and extends there through to engage with or disengage from the back body portion depending upon which direction the lock wheel is turned in relation to the main portion.

Referring to FIGS. 3*a*-4*c*, in this example embodiment, the utility knife 100 further includes a blade carrier 130, a blade hood 132, a pushrod 134, a blade release member 136, and a slider 138, configured as shown.

Figure 15A:
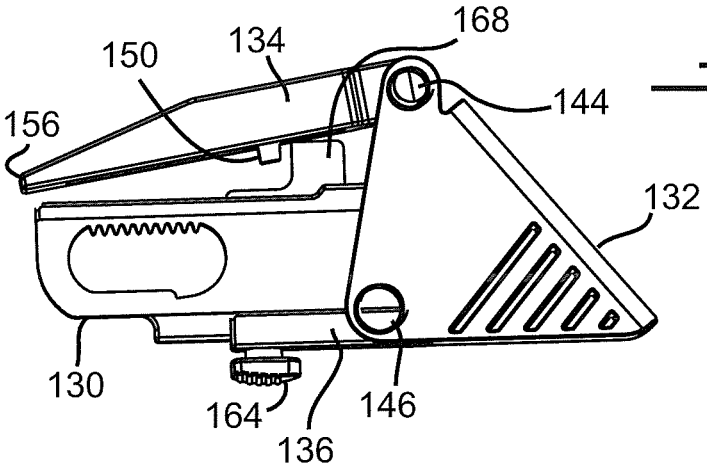
FIGS. 15*a* and 15*b* are right and left side views, respectively, of the blade carrier, blade, blade hood, pushrod, and blade release member.
Figure 15B:
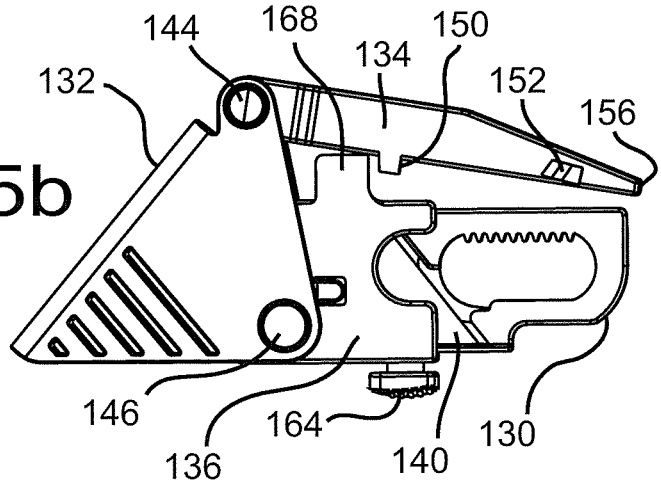
Figure 16A:
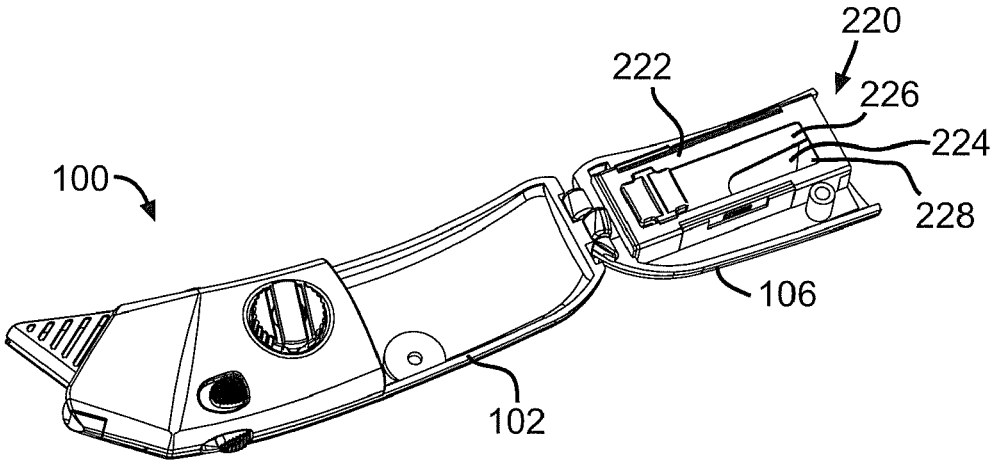
FIG. 16*a* illustrates how the right back portion of the utility knife can be pivoted to an opened position to reveal the spare blade dispenser secured therein.
Figure 16B:
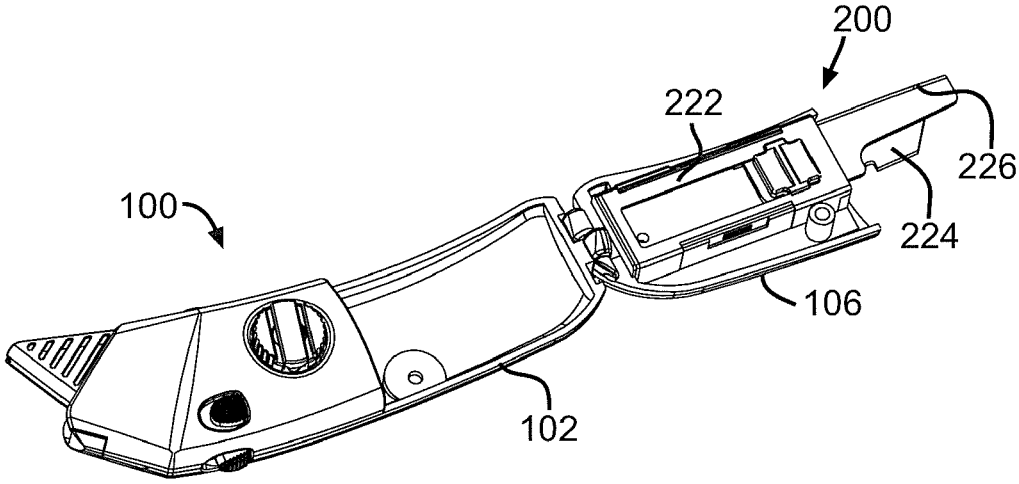
FIG. 16*b* illustrates how the shuttle of the spare blade dispenser engages and extends a topmost spare blade from the blade receptacle.
Figure 16C:
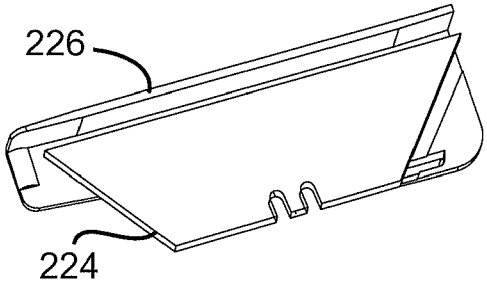
FIG. 16*c* is a perspective view of the shuttle shown with a blade supported thereon.

The blade carrier 130 (e.g., made from zinc) is mechanically coupled to the handle and configured to support a blade 140 (FIG. 15*d*).

Figure 3A:
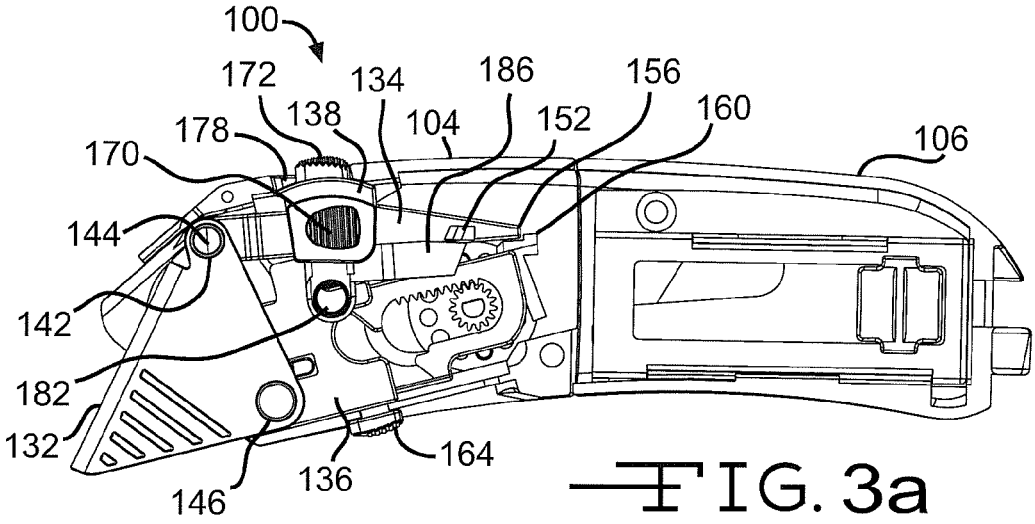
FIG. 3*a* is a left side view of the utility knife shown with its left side (or main) body portion removed.
Figure 3B:
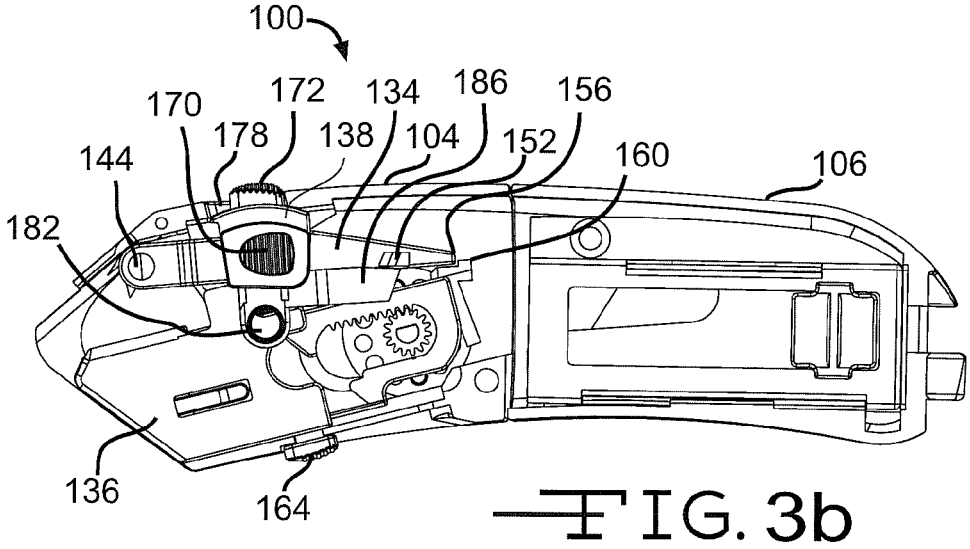
FIG. 3*b* is a left side view of the utility knife shown with its left side (or main) body portion and blade hood removed.
Figure 3C:
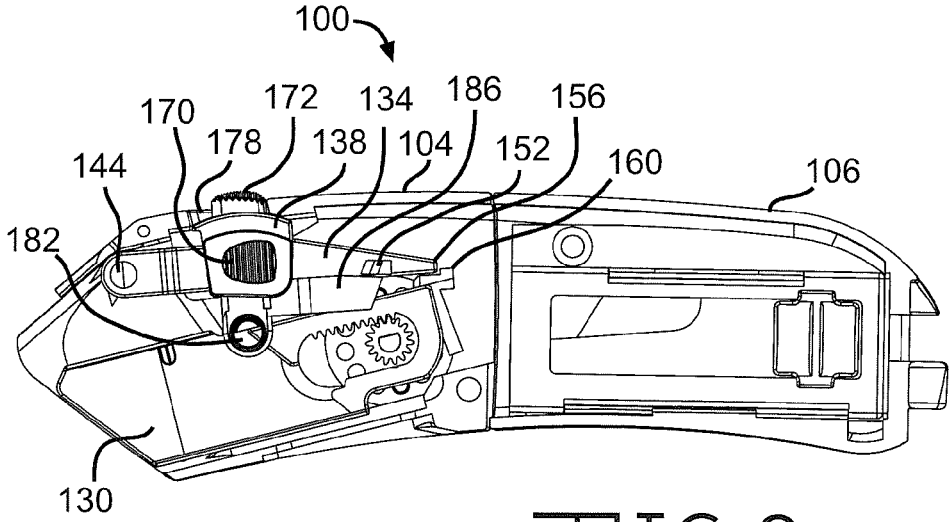
FIG. 3*c* is a left side view of the utility knife shown with its left side (or main) body portion, blade hood, and blade release member removed.
Figure 4A:
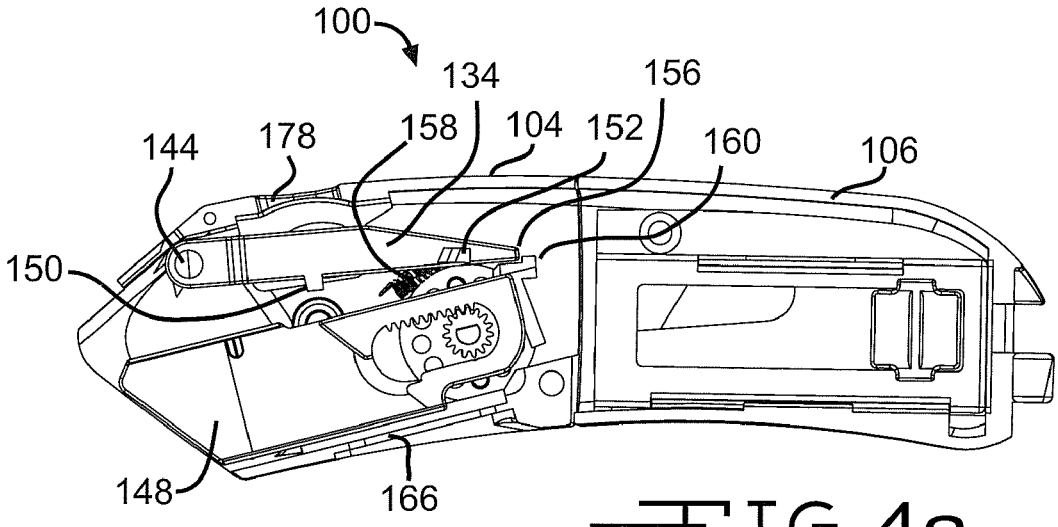
FIG. 4*a* is a left side view of the utility knife shown with its left side (or main) body portion, blade hood, blade release member, and slider removed.
Figure 4B:
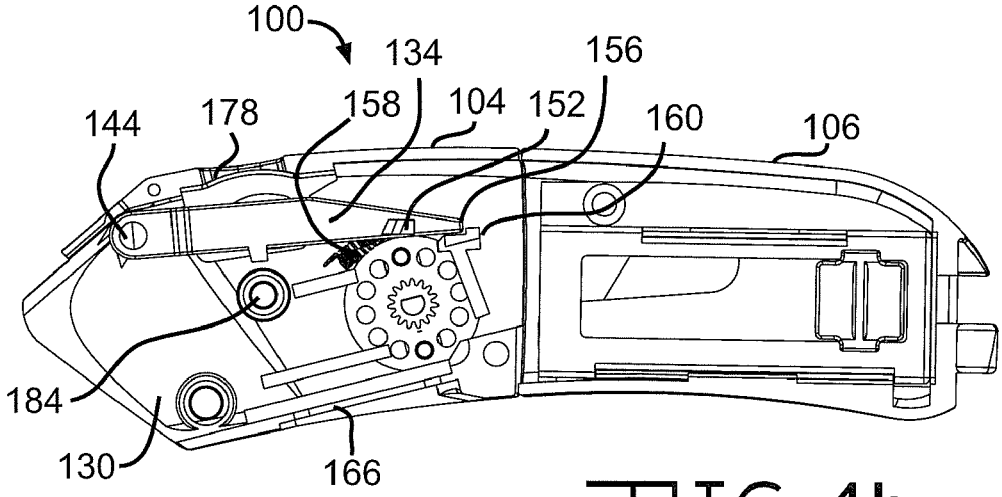
FIG. 4*b* is a left side view of the utility knife shown with its left side (or main) body portion, blade hood, blade release member, slider, and blade carrier removed.
Figure 4C:
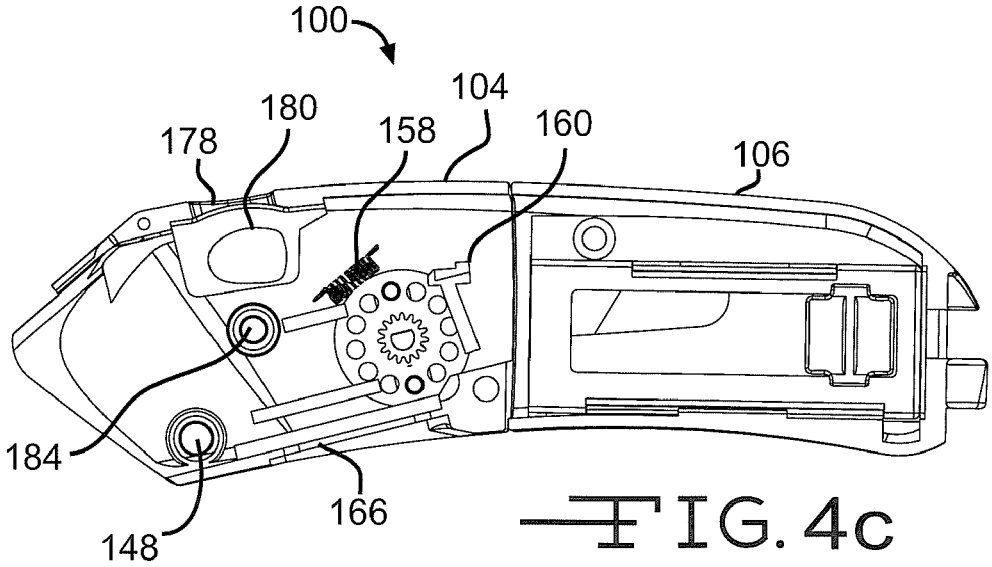
FIG. 4*c* is a left side view of the utility knife shown with its left side (or main) body portion, blade hood, blade release member, slider, blade carrier, and pushrod removed.
Figure 5A:
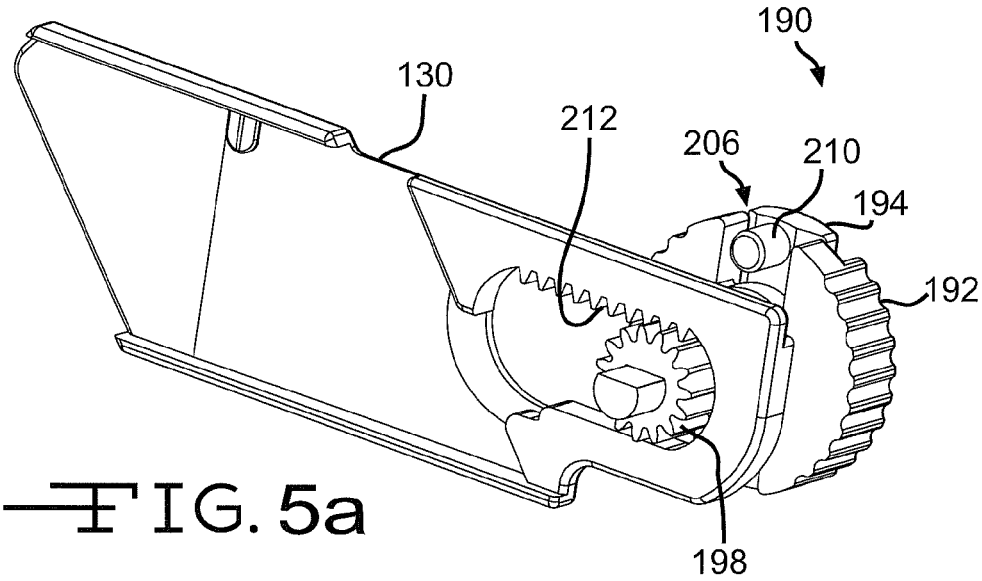
FIG. 5*a* is a perspective view showing how the blade depth adjustment assembly is mechanically engaged with the blade carrier.
Figure 5B:
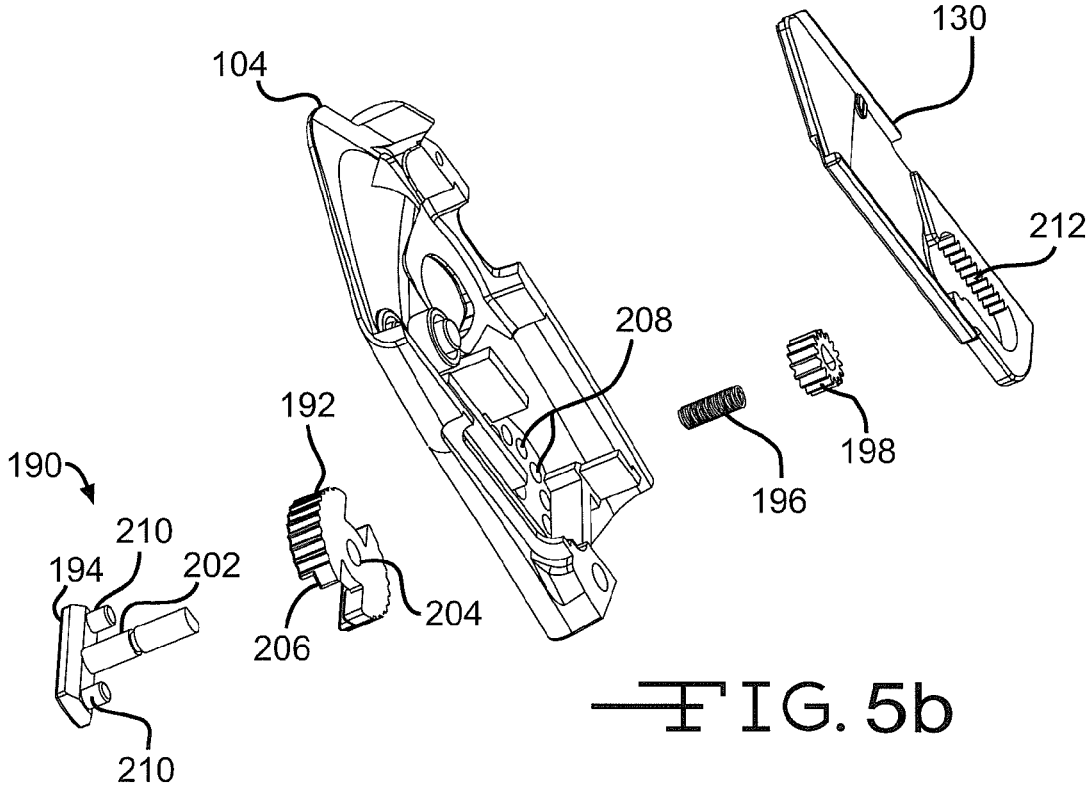
FIG. 5*b* is an exploded perspective view showing the right front body portion, the blade depth adjustment assembly, and the blade carrier.
Figure 6A:
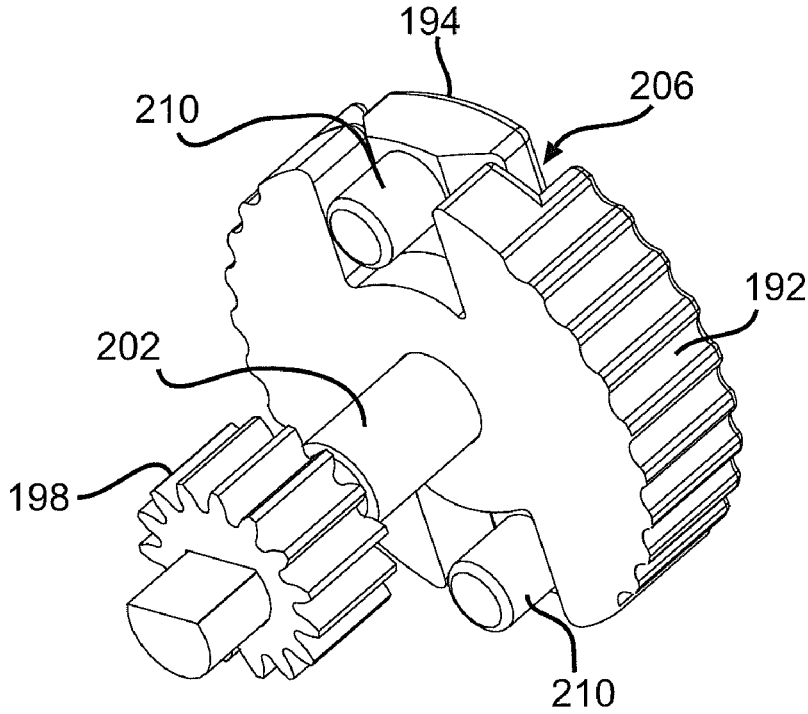
FIG. 6*a* is an enlarged perspective view of the blade depth adjustment assembly.
Figure 6B:
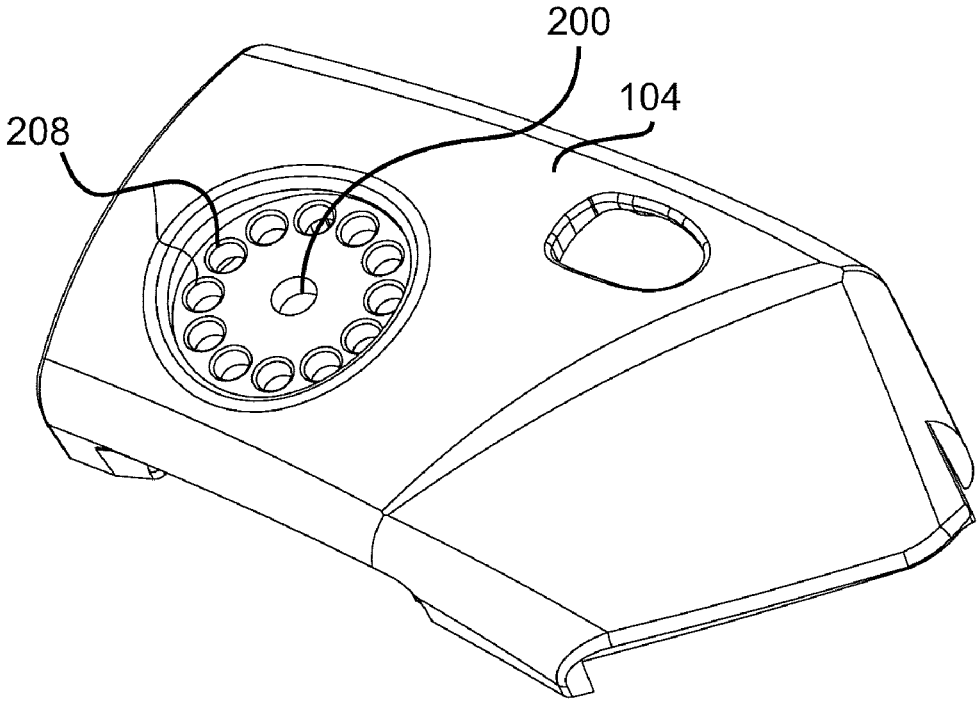
FIG. 6*b* is a right perspective view of the right front body portion.
Figure 7A:
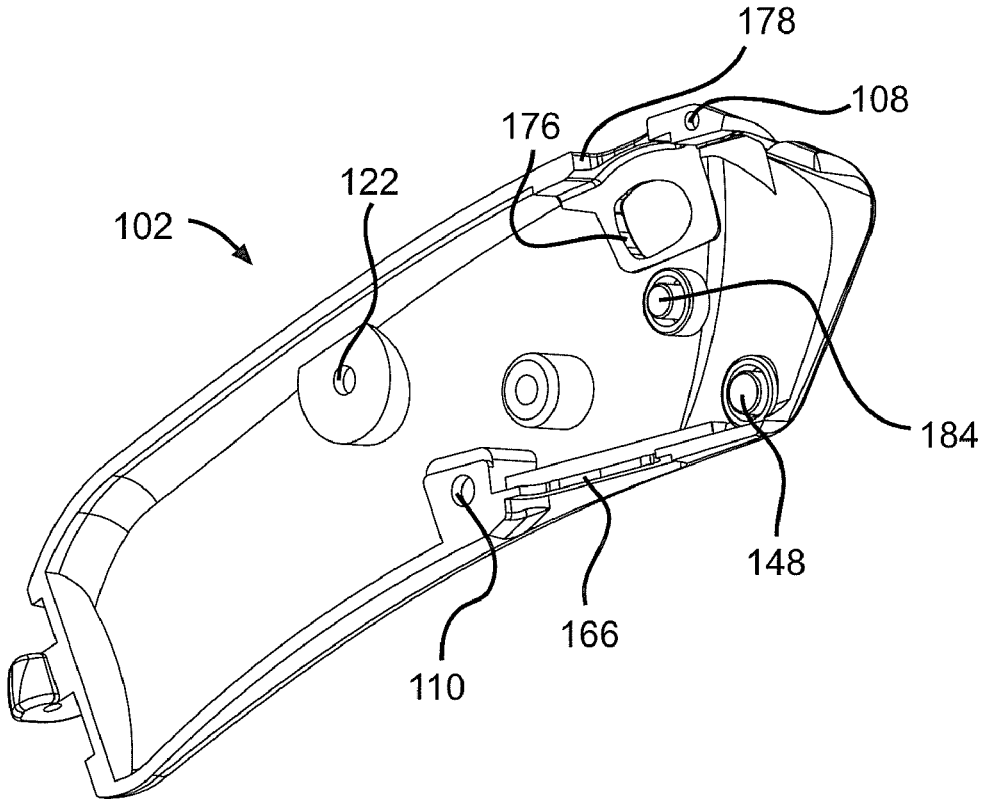
FIG. 7*a* is a perspective view of the inside of the left side (or main) body portion.
Figure 7B:
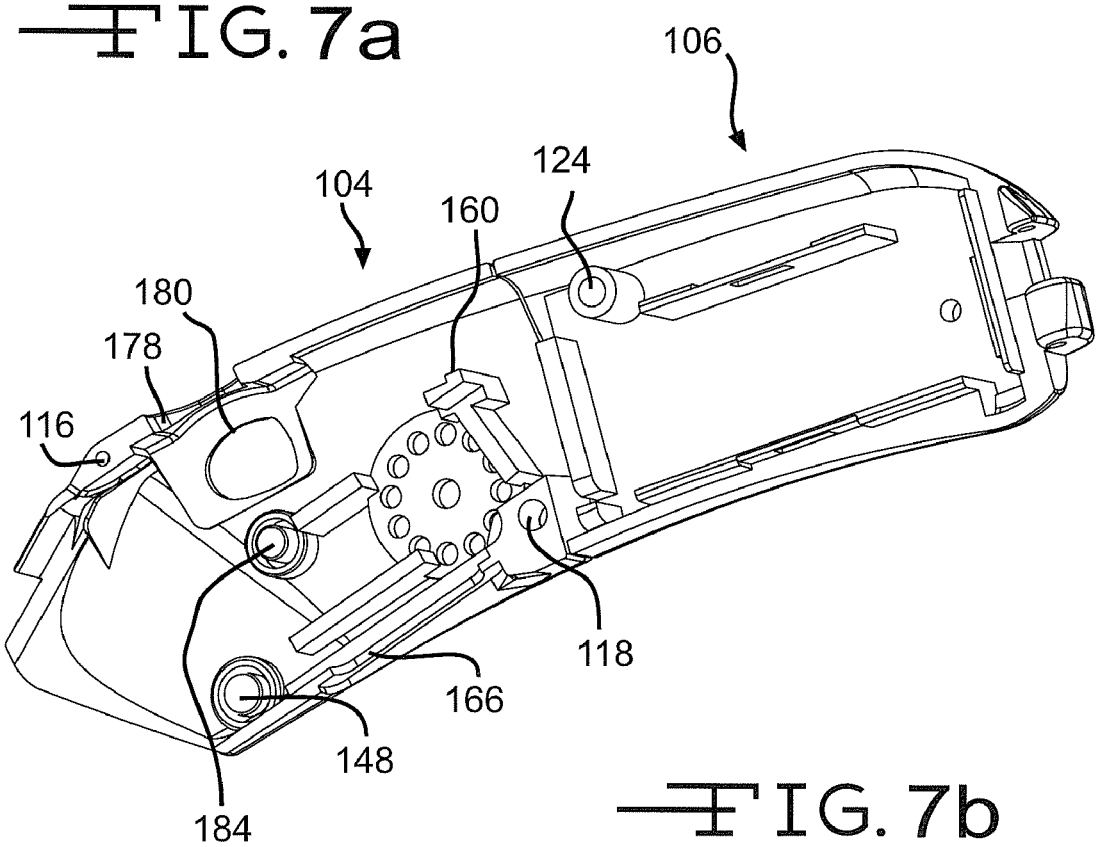
FIG. 7*b* is a perspective view of the inside of the right front body portion and the right back body portion.
Figure 14A:
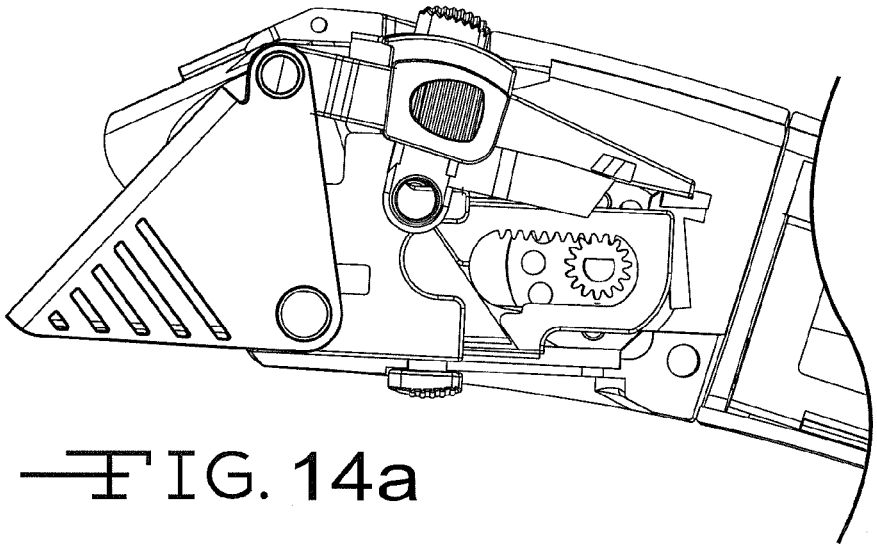
FIGS. 14*a*-14*c* illustrate how movement of the blade release member causes the blade hood to retract from its default extended position.

The blade hood 132 (e.g., made from sheet metal) is mechanically coupled to the handle facilitating manipulability of the blade hood 132 to an extended position over the blade 140 (FIG. 14*a*). In an example embodiment, the blade hood 132 is pivotally coupled to the handle. Referring to FIG. 3*a*, in this example embodiment, the blade hood 132 includes cylindrical channels 142 on opposite sides of the blade hood 132. The cylindrical channels 142 are sized to receive bearings 144 of the pushrod 134. Referring also to FIGS. 7*a* and 7*b*, in this example embodiment, cylindrical channels 146 of the blade hood 132 are sized to receive hood pivots 148 from opposite sides of the blade hood 132, thereby pivotally securing the blade hood 132 to the handle.

Figure 9A:
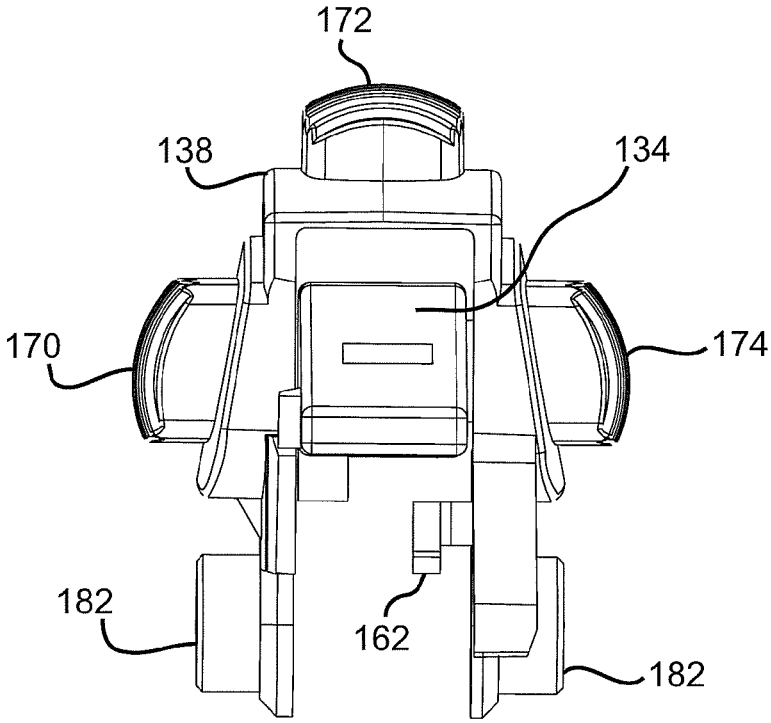
FIG. 9*a* is a back view of slider and pushrod shown together.
Figure 9B:
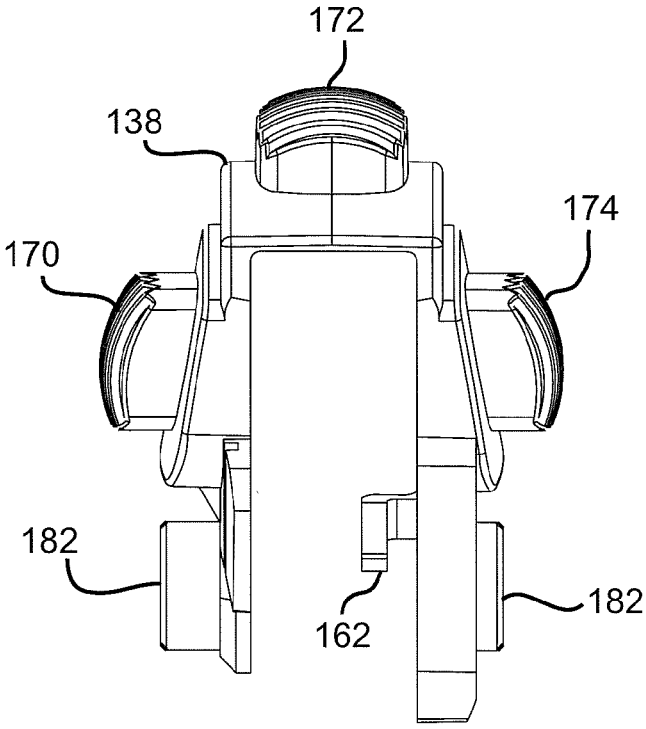
FIG. 9*b* is a back view of the slider.
Figure 10A:
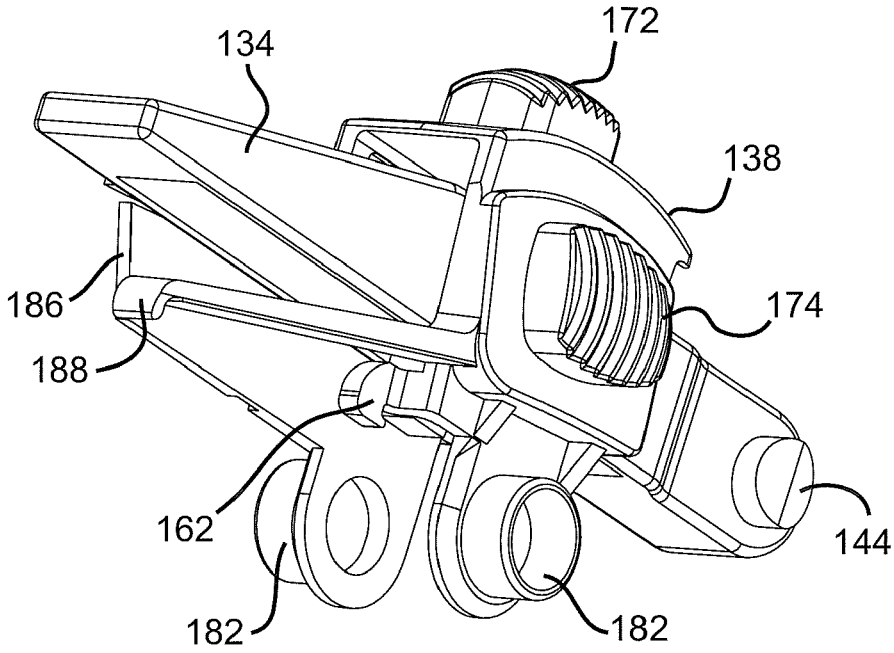
FIG. 10*a* is right perspective view of the slider and pushrod shown together.
Figure 10B:
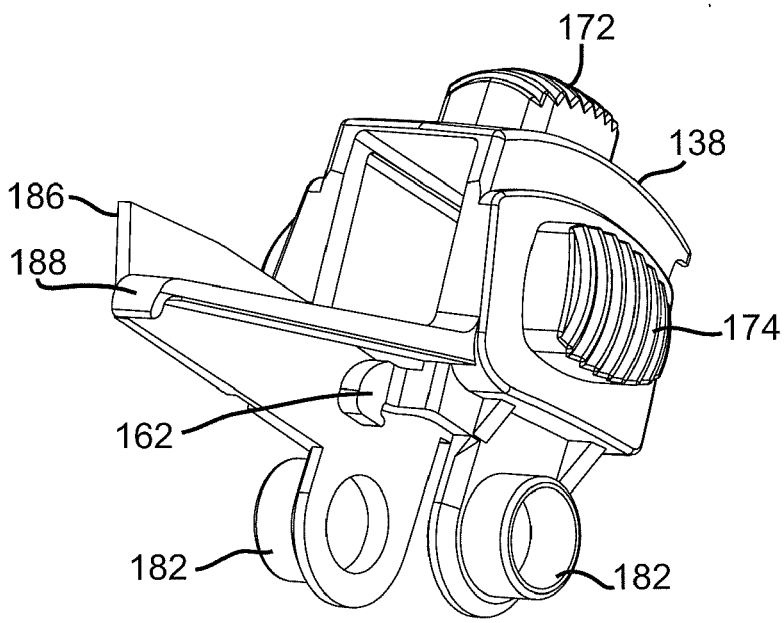
FIG. 10*b* is right perspective view of the slider.
Figure 11A:
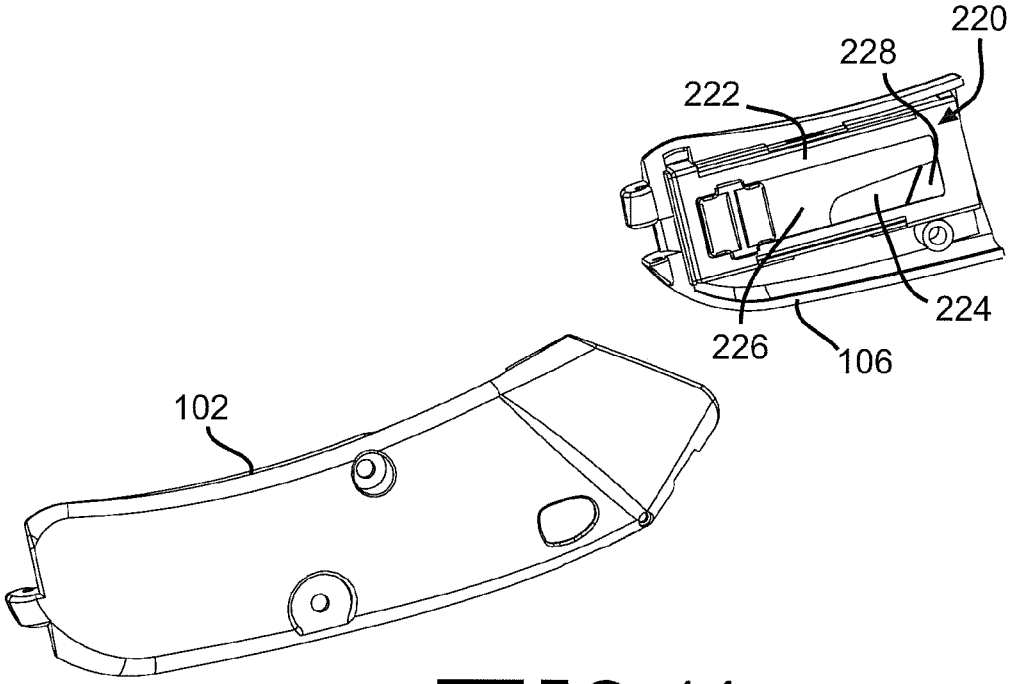
FIG. 11*a* is a perspective view of the right back body portion separated from the left side (or main) body portion showing the spare blade dispenser secured to the right back body portion.
Figure 11B:
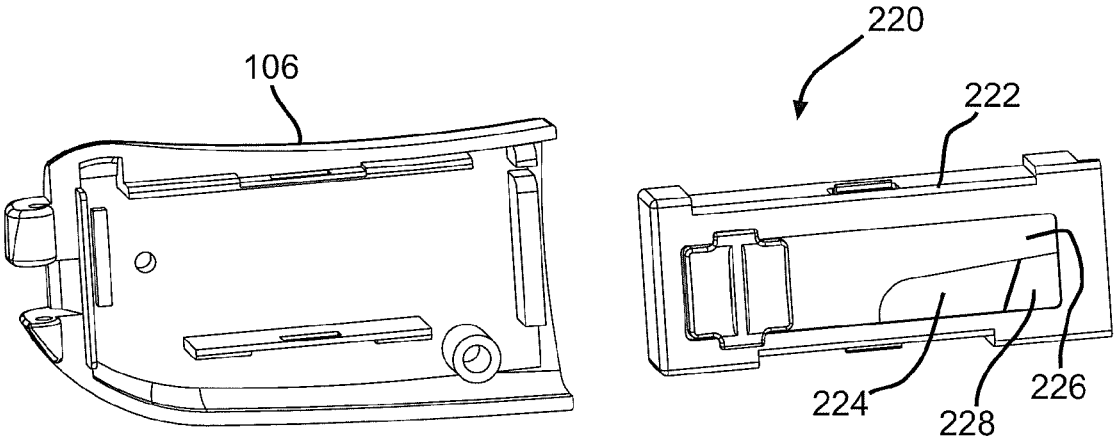
Figure 12A:
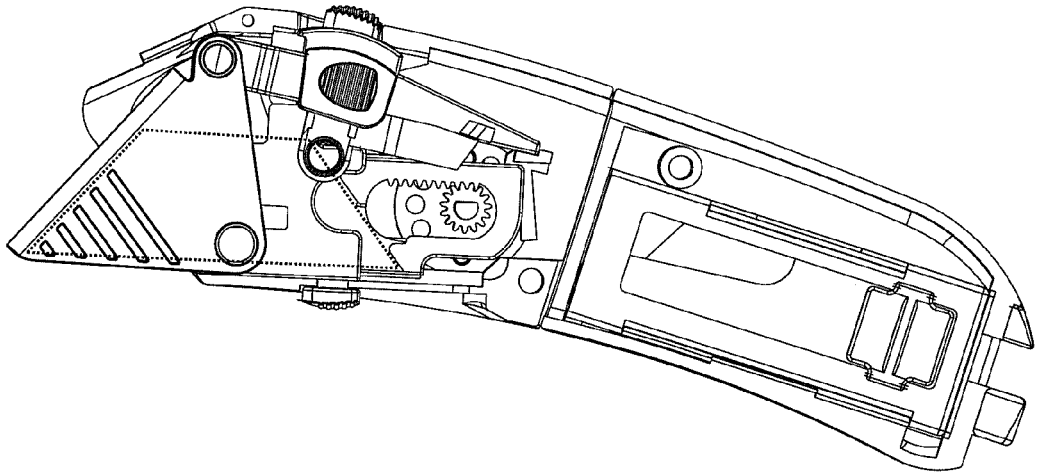
FIGS. 12*a*, 12*b*, 13*a* and 13*b* illustrate operation of the blade depth adjustment assembly.
Figure 12B:
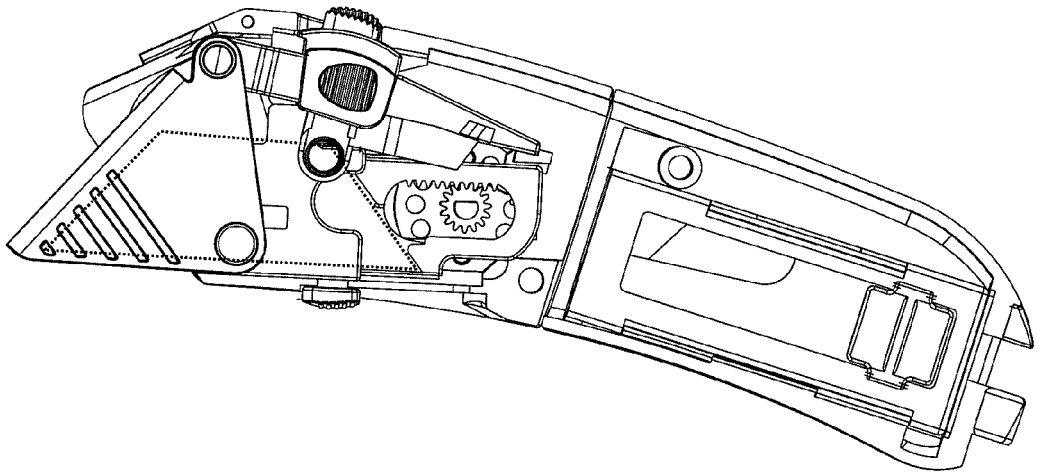
Figure 13A:
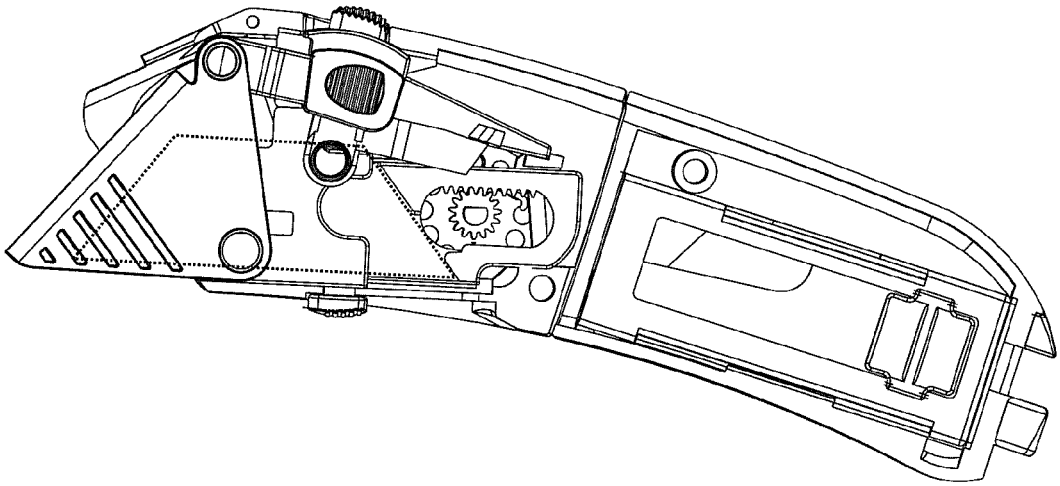
Figure 13B:
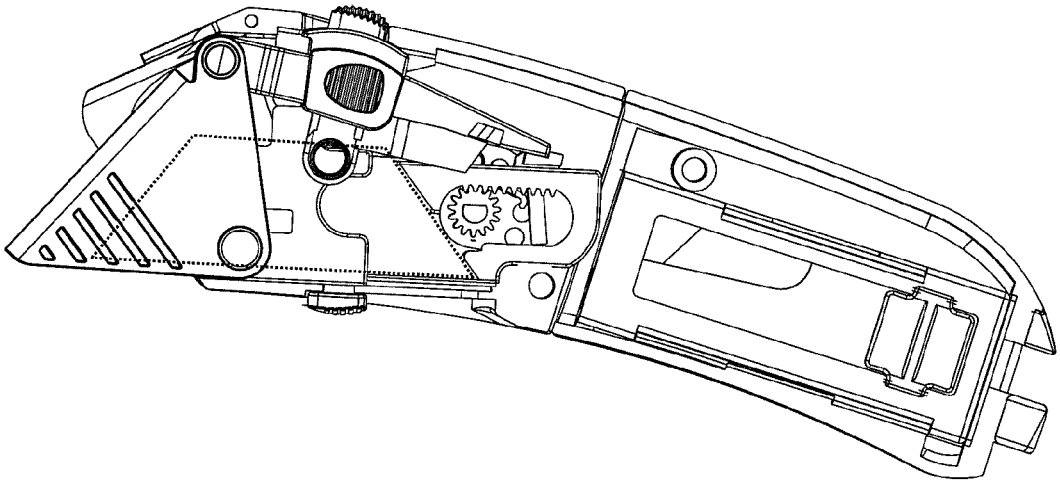

The pushrod 134 (e.g., made from POM or metal) is mechanically coupled to the blade hood 132 and includes a protrusion 150 (FIG. 4*a*) that extends toward the blade carrier 130. In this example embodiment, the pushrod 134 includes a lift ramp 152 and a spring anchor 154 (FIG. 15*c*) formed as shown. In an example embodiment, the pushrod 134 is entirely rigid. In this example embodiment, an end portion 156 of the pushrod 134 is positioned adjacent to a stop 160 (FIG. 7*b*) in the handle when the blade hood 132 is in its extended position. In this example embodiment, a spring 158 (FIG. 4*a*) is connected between the spring anchor 154 of the pushrod 134 and a spring anchor 162 (FIG. 9*a*) of the slider 138 and serves as a mechanism for urging the blade hood 132 toward its extended position. In this example embodiment, the end portion 156 is in contact with the stop 160 when the blade hood 132 is in the extended position.

The blade release member 136 (e.g., made from POM) includes a button 164 that extends through a slot 166 in the housing. The blade release member 136 is mechanically engaged with the blade carrier 130 to slide there along when the button 164 is moved along the slot 166. The blade release member 136 includes an upper portion 168 (FIG. 15*a*) that makes contact with the protrusion 150 (of the pushrod 134) when the blade release member 136 is moved along the slot 166 such that the pushrod 134 is repositioned within the handle and the blade hood 132 is retracted from the extended position to allow the blade 140 to be removed from the blade carrier 130.

Figure 8A:
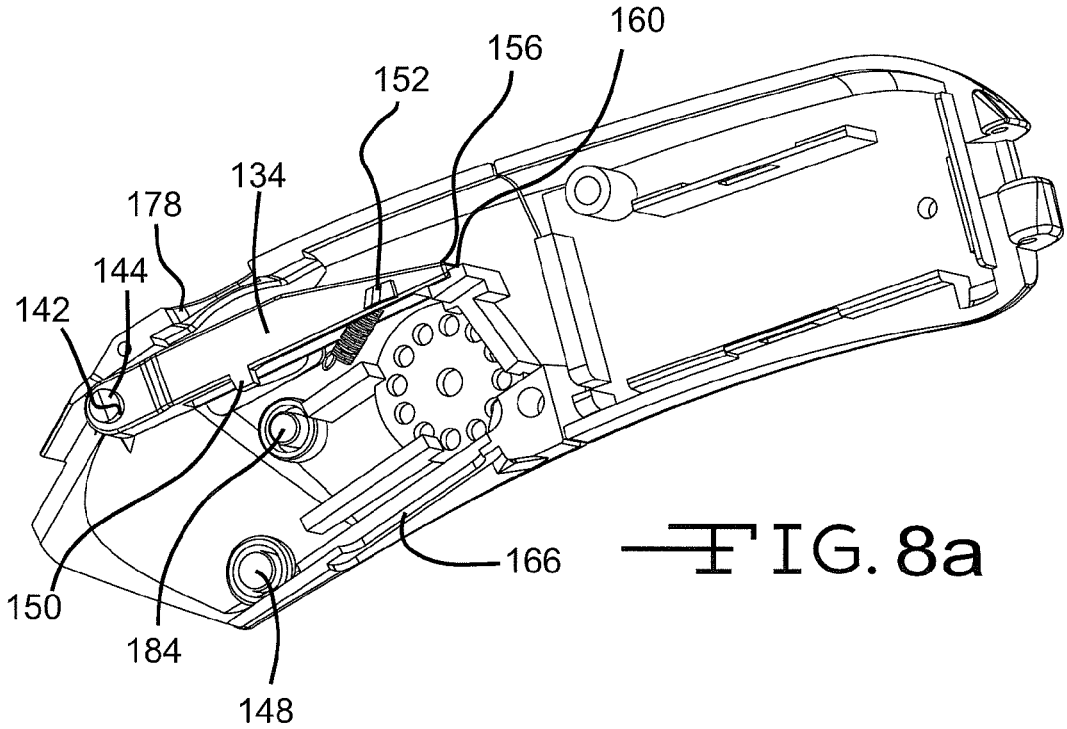
FIG. 8*a* is a perspective view of the inside of the right front body portion and the right back body portion, with the pushrod and return spring also shown.
Figure 8B:
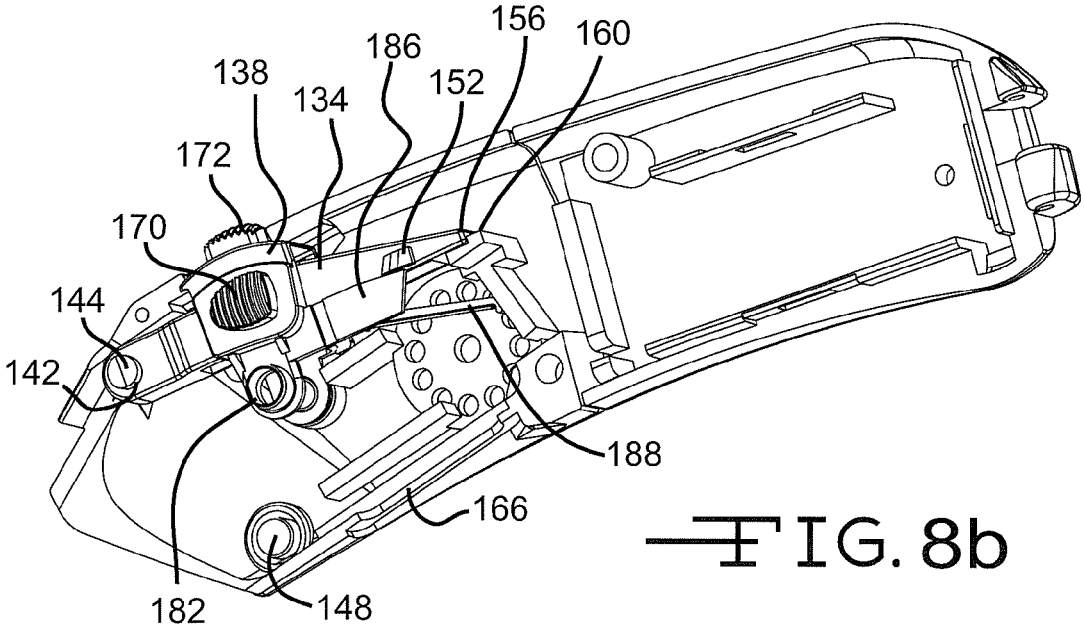
FIG. 8*b* is a perspective view of the inside of the right front body portion and the right back body portion, with the pushrod, return spring, and slider also shown.

The slider 138 (e.g., made from POM), in this example embodiment, includes buttons 170, 172 and 174 which extend respectively through openings 176, 178 and 180 in the handle. In an example embodiment, the slider includes one or more buttons that extend through the handle, at least one of the buttons extending through a top side of the handle opposite a cutting edge of the blade. In this example embodiment, the slider 138 includes cylindrical channels 182 which are formed and sized as shown to receive bearings 184 (FIGS. 7*a* and 7*b*) for pivotally coupling the slider 138 to the handle. In this example embodiment, the slider 138 includes a lifter member (or lifter) 186 (FIG. 8*b*) formed as shown. In this example embodiment, the slider 138 includes a return spring 188 formed as shown. As discussed below, the return spring 188 imparts a force tending to urge the slider 138 away from a position that releases the blade hood 132.

The blade hood 132 needs to be released from its extended position both when the utility knife is to be used to cut a work piece, as well as when a forward blade change operation is to be performed.

A function of the slider 138 is to release the blade hood 132 from being locked into its extended position. This is accomplished by repositioning the slider 138 along the handle (i.e., by pushing any one of the buttons 170, 172 and 174 forward). More specifically, the slider 138 is configured to manipulate the pushrod 134 in relation to the stop 160. When the slider 138 is pushed forward, the lifter member 186 bears against the lift ramp 152 of the pushrod 134, raising the end portion 156 allowing the pushrod 134 to traverse the stop 160.

Figure 14B:
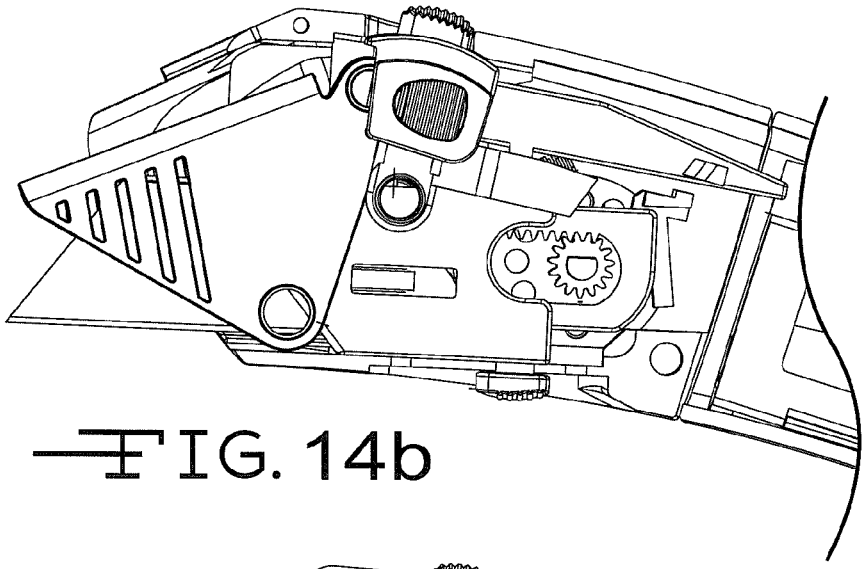
Figure 14C:
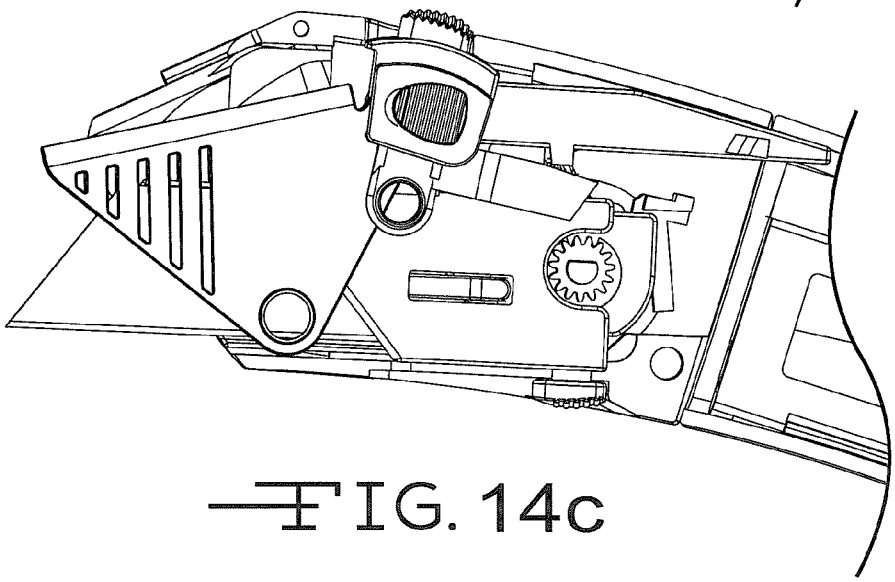

FIGS. 14*a*-14*c* illustrate how movement of the blade release member 136 causes the blade hood 132 to retract from its default extended position. As mentioned above, in this example embodiment, it is first necessary to reposition the slider 138 forward (to facilitate movement of the pushrod 134 past the stop 160) prior to repositioning the blade release member 136 along the slot 166 to release the blade 140. In operation, when the blade release member 136 is pulled backward, the upper portion 168 comes into contact with the protrusion 150. This causes the pushrod 134 to move backward along the handle along with the blade release member 136. Because the pushrod 134 is pivotally coupled to the blade hood 132 as previously described, this movement of the pushrod 134, in turn, causes the blade hood 132 to retract from its extended position (FIG. 14*a*) to a semi-retracted position (FIG. 14*b*) to a fully-retracted position (FIG. 14*c*).

Referring to FIGS. 5*a*-6*b*, in this example embodiment, the utility knife 100 includes a blade depth adjustment assembly 190 which is mechanically coupled to the handle and configured to permit a user of the utility knife 100 to reposition components of the blade depth adjustment assembly 190 to select one of multiple blade depth positions which causes the blade carrier 130 to be repositioned along the handle depending upon which of the blade depth positions is selected.

In this example embodiment, the blade depth adjustment assembly 190 includes a wheel 192, a depth selector member 194, a spring 196, and a gear 198, formed and configured as shown such that the blade carrier 130 is repositioned along the handle in response to the wheel 192 being repositioned in relation to the handle.

The wheel 192 extends from an opening 200 (FIG. 6*b*) in the handle. More specifically, in this example embodiment, the depth selector member 194 interfits with the wheel 192 and includes a shaft 202 that passes through an opening 204 in the wheel 192 and also through the opening 200. In this example embodiment, the wheel 192 includes a channel 206 and the depth selector member 194 is configured to be seated within the channel 206 when the depth selector member 194 has locked the blade carrier 130 into a selected blade depth position.

The depth selector member 194 is formed and configured to lock the blade carrier 130 into a selected blade depth position. More specifically, the right front body portion 104 includes recessed portions 208 (FIG. 6*b*) as shown, and the depth selector member 194 includes a peg 210 (in this example embodiment, two pegs 210) sized to interlock with one of the recessed portions 208 depending upon which of the blade depth positions is selected.

The spring 196 is configured to bias the depth selector member 194 toward a position where the depth selector member 194 locks the blade carrier, i.e., the spring imparts a force that seeks to pull the peg 210 into whichever recessed portion 208 it is positioned over. In this example embodiment, the spring 196, which is fitted over the shaft 202, is positioned between the gear 198 and the right front body portion 104.

The gear 198 is secured to the shaft 202 and mechanically engages with a complementary surface 212 (e.g., a surface with teeth complementary to those of the gear 198) of the blade carrier 130.

In operation, and referring to FIGS. 12*a*, 12*b*, 13*a* and 13*b*, the depth selector member 194 is pulled (against the force of the spring 196) to withdraw the peg 210 from whatever recessed portion 208 it was previously seated in. This frees the wheel 192 to be rotated. The gear 198 is fixed in relation to the wheel and, therefore, rotation of the gear 198 causes the blade carrier 130 to move laterally along the length of the handle depending upon which direction the wheel 192 is being turned.

Referring to FIGS. 11*a*-11*b* and 16*a*-16*c*, in this example embodiment, the utility knife 100 also includes a spare blade dispenser 220 secured to the right back body portion (back portion) 106 to be accessible by a user of the utility knife 100 when the back portion is in the opened position. The spare blade dispenser 220 includes a blade receptacle 222 sized to hold spare blades 224 and a shuttle 226 mechanically coupled to the blade receptacle 222 such that the shuttle 226, when repositioned laterally with respect to the blade receptacle 222, engages and extends a topmost spare blade 224 from the blade receptacle 222. In this example embodiment, the spare blade dispenser 220 includes a spring 228 (e.g., a leaf spring) configured to bias the spare blades 224 toward the shuttle 226. In an example embodiment, the spare blade dispenser 220 is detachably secured to the back portion facilitating replacement of the entire spare blade dispenser 220 as a module. By way of example, the spare blade dispenser 220 is snap fitted to the back portion.

Although the present invention has been described in terms of the example embodiments above, numerous modifications and/or additions to the above-described embodiments would be readily apparent to one skilled in the art. It is intended that the scope of the present invention extend to all such modifications and/or additions.

What is claimed is:

1. A utility knife comprising:

a handle;

a blade carrier mechanically coupled to the handle, the blade carrier being configured to support a blade;

a blade hood mechanically coupled to the handle facilitating manipulability of the blade hood to an extended position over the blade;

a pushrod mechanically coupled to the blade hood, the pushrod including a protrusion that extends toward the blade carrier; and a blade release member including a button that extends through a slot in the handle, the blade release member being mechanically engaged with the blade carrier to slide there along when the button is moved along the slot, the blade release member including an upper portion that makes contact with the protrusion when the blade release member is moved along the slot such that the pushrod is repositioned within the handle and the blade hood is refracted from the extended position to allow the blade to be removed from the blade carrier.

2. The utility knife of claim 1, further comprising:

a slider that is repositionable along the handle to release the blade hood from the extended position.

3. The utility knife of claim 2, wherein the slider being pivotally coupled to the handle.

4. The utility knife of claim 2, wherein:

the handle includes a stop; and the slider is configured to manipulate the pushrod in relation to the stop.

5. The utility knife of claim 4, wherein the slider includes a lifter member that bears against the pushrod when the slider is moved into a position that releases the blade hood.

6. The utility knife of claim 5, wherein the slider includes a return spring that imparts a force tending to urge the slider away from the position that releases the blade hood.

7. The utility knife of claim 1, wherein the blade hood is pivotally coupled to the handle.

8. The utility knife of claim 1, wherein the slider includes one or more buttons that extend through the handle, at least one of the buttons extending through a top side of the handle opposite a cutting edge of the blade.

9. The utility knife of claim 1, wherein the slider includes three buttons that extend through the handle.

10. The utility knife of claim 1, further comprising:

a spring configured to bias the blade hood toward the extended position.

* * * * *